US007926563B2

(12) United States Patent
Khomynets

(10) Patent No.: US 7,926,563 B2
(45) Date of Patent: Apr. 19, 2011

(54) WELL JET DEVICE FOR WELL-LOGGING OPERATIONS AND THE OPERATING METHOD THEREOF

(76) Inventor: Zinoviy Dmitrievich Khomynets, Moscow (RU)

( * ) Notice: Subject to any disclaimer, the term of this patent is extended or adjusted under 35 U.S.C. 154(b) by 260 days.

(21) Appl. No.: 12/279,833

(22) PCT Filed: Nov. 28, 2006

(86) PCT No.: PCT/RU2006/000633

§ 371 (c)(1),
(2), (4) Date: Aug. 18, 2008

(87) PCT Pub. No.: WO2007/108717

PCT Pub. Date: Sep. 27, 2007

(65) Prior Publication Data

US 2010/0147513 A1 Jun. 17, 2010

(30) Foreign Application Priority Data

Mar. 22, 2006 (RU) ..... 2006108886

(51) Int. Cl.
*E21B 47/00* (2006.01)

(52) U.S. Cl. ..... 166/252.1; 166/250.01; 73/152.12; 73/152.17; 73/152.26

(58) Field of Classification Search ..... 166/250.01, 166/252.1, 385, 66; 73/152.12, 152.17, 152.26
See application file for complete search history.

(56) References Cited

U.S. PATENT DOCUMENTS

| | | | | |
|---|---|---|---|---|
| 4,718,486 | A * | 1/1988 | Black | 166/68 |
| 4,988,389 | A * | 1/1991 | Adamache et al. | 166/302 |
| 5,099,919 | A * | 3/1992 | Schneider et al. | 166/188 |
| 2004/0071557 | A1 | 4/2004 | Khomynets | |
| 2008/0115934 | A1 * | 5/2008 | Pettinato et al. | 166/254.1 |
| 2008/0264634 | A1 * | 10/2008 | Khomynets | 166/254.2 |

FOREIGN PATENT DOCUMENTS

| | | | |
|---|---|---|---|
| RU | 2059891 | C1 | 5/1996 |
| RU | 2106540 | C1 | 3/1998 |
| RU | 2160634 | C1 | 12/2000 |

* cited by examiner

*Primary Examiner* — Jennifer H Gay
*Assistant Examiner* — Cathleen R Hutchins
(74) *Attorney, Agent, or Firm* — patenttm.us

(57) ABSTRACT

A jet pump on pipe string and packer, pump body being provided with steplike pass channel embodied therein and communicates with pumped-out medium supplying channel and active medium supplying channel, connected to active nozzle at the output and to annular space. The pumped-out medium-supplying channel connects to the pipe string downstream of steplike channel via return valve. A hollow steplike cylindrical body sealing unit provided with a top part sealing element arranges in said steplike channel. An annular projection supported spring-loaded steplike piston is downstream. The piston lower position closes unit body holes. When the piston is in top position, the channel for supplying medium pumped-out from the well through the unit holes and pump bodies connects to the pipe string downstream of the pump body. The piston and sealing element include coaxial channels therein, used for passing a cable with logging instrument suspended below the pump body.

3 Claims, 2 Drawing Sheets

WELL JET DEVICE FOR WELL-LOGGING OPERATIONS AND THE OPERATING METHOD THEREOF

BACKGROUND OF THE INVENTION

1. Field of the Invention

This invention relates to pump engineering, primarily to well jet devices used for well logging and to methods of operating thereof.

2. Background Art

A well jet device is known that comprises a pipe string with a jet pump and a packer with the possibility of pumping a working medium through the jet pump (RU 2059891 C1).

The same source teaches a method of operating a well jet device, comprising arranging a jet pump on a pipe string in a well and a geophysical instrument installed below the jet pump in a flow string, lowering the pipe string with the jet pump, the packer and the geophysical instrument into a well and pumping a liquid working medium through the jet pump.

These known well jet device and the operating method thereof enable to pump a variety of produced media, e.g., oil, from wells, while simultaneously treating the produced medium and the near-well area of a formation.

However, working capabilities of the known device and method are limited in studying wells that narrows their application in a number of cases.

The closest to this invention as to the technical essence and the achieved result is a well jet device comprising a pipe string, a packer and a jet pump in the body of which an active nozzle with a mixing chamber is installed and a pass-through channel with a mounting seat for installing a sealing unit with an axial channel is made, the jet pump output being connected to the pipe string above the sealing unit, the entry of a channel for supplying a pumped-out medium to the jet pump being connected to the pipe string below the sealing unit, and the entry of a channel for supplying a working medium to the active nozzle being connected to space surrounding a flow string, and several channels for supplying a pumped out medium being made in the jet pump body (RU 2106540 C1).

The same patent teaches a method of operating a well jet device, comprising arranging a packer and a jet pump on a pipe string in a well, the packer being installed above a producing formation, lowering a sealing unit and a well-logging instrument on a cable, and pumping an active working medium, e.g., water, along the pipe string annular space to the jet pump nozzle, thus reducing pressure in an under-packer area and creating a pressure drawdown on the formation, monitoring parameters of the pumped-out formation fluid when the jet pump is operated, and equalizing pressures along the jet pump flow channel by flowing a fluid through the jet pump flow channel after stopping supplying the active working medium.

These device and operating method thereof enable to carry out various technological operations in a well below the level at which the jet pump is installed, including those involving reducing pressure differential above and under the sealing unit.

However, this device does not enable to utilize its capabilities in full due to the fact that it is impossible to maintain pressure drawdown on a formation when the jet pump is not operated, which does not enable to study wells in full.

BRIEF SUMMARY OF THE INVENTION

The objective of this invention is to improve operation reliability and efficiency of a well jet device when testing wells and optimizing operation sequence when testing a well.

The stated objective is solved in respect of the device due to that the inventive well jet device for well-logging operations comprises a jet pump, which is installed on a pipe string, and a packer, an active nozzle and a mixing chamber with a diffuser being arranged in alignment in the jet pump body as well as a step-like pass-through channel with a mounting seat between steps, a channel for supplying a pumped-out medium communicating with the step-like pass-through channel via lateral openings made in the jet pump body, and a channel for supplying an active working medium communicating on its output side with the active nozzle and on its input side with the pipe string annular space being made in the jet pump body, and the channel for supplying a pumped-out medium is connected to the pipe string below the step-like channel via a return valve, the step-like pass-through channel provides for the possibility of installing a sealing unit therein which is made as a hollow step-like cylindrical body with a sealing element in its upper part and a step-like piston, which is spring-loaded against the sealing element and rests on an annular shoulder made in the sealing unit body cavity. Openings are made in the sealing unit body wall opposite to the lateral openings in the jet pump body, and the step-like piston in its lower position closes the openings in the sealing unit body wall, and when the step-like piston is in its upper position the channel for supplying a pumped-out medium is connected to the pipe string below the jet pump body via the lateral openings in the jet pump body and the openings in the sealing unit body wall, axial channels being made in alignment in the step-like piston and in the sealing element for the purpose of passing a logging cable on which a logging instrument is suspended via a cable head below the jet pump body.

The stated objective in respect of the inventive method is solved due to that the method of operating a well jet device for well-logging operations comprises assembling a pipe string by installing a jet pump and a packer on a pipe string, lowering the assembled unit into a well and releasing the packer, lowering a sealing unit on a logging cable with a logging instrument attached to the cable via a cable head, the sealing unit is installed on the mounting seat in the jet pump step-like channel, and the logging instrument is arranged in the area of a producing formation, during lowering background values of rock physical fields, in particular those of thermal fields, are recorded along the well bore, then pressure drawdown on the producing formation is created by supplying an active working medium to the active nozzle along the pipe string annular space and, thus, the producing formation is drained, then, when the jet pump is operated, current values of rock physical fields and the formation fluid coming to the well are recorded. In the course of recording the logging instrument is moved along the well bore, including the producing formation, with the use of the logging cable, then the jet pump is stopped, and the pipe string inner cavity above the jet pump together with the annular space above the packer is separated from the pipe string inner cavity under the jet pump together with the under-packer space by using a return valve, maintaining a reduced bottom-hole pressure under the packer, then the logging instrument is slightly raised with the use of the logging cable and the step-like piston is pressed by the cable head for moving it up, and, thus, the under-packer space of the well is brought in communication with the pipe string inner cavity through the openings in the sealing unit body wall and the lateral openings in the jet pump body, and, due to this, pressures above and below the packer are equalized, after which the logging instrument together with the sealing unit is removed from the well.

An analysis of various designs shows that operation reliability may be improved by expanding the functional capabilities of the device when testing and developing wells.

It has been found that the above set of the device design elements enables to organize a sequence of operations at which equipment, as installed on a pipe string for the purpose of well logging for studying, testing and developing producing formations in rocks, is used most efficiently. It creates conditions both for obtaining complete and reliable information on the condition of producing formations and for treating producing formations in the course of studies. The inventive well jet device enables to produce a number of different pressure drawdown values by using a jet pump in the well under-packer area at pre-defined pressure differentials, record pressures, temperatures and other physical parameters of a well and a medium pumped out of a well by using a logging instrument, conduct studies and tests of a well as well as record formation pressure recovery curve for the under-packer area of a well without using a special functional insert. At the same time, a possibility of monitoring pressure drawdown values by controlling the active working medium pumping rate is provided. It becomes possible, when testing formations, to control the pumping mode by changing pressure of an active working medium supplied to the jet pump active nozzle. At the same time, a possibility of a working medium flow into the under-packer area is precluded when a jet pump is or is not operated.

In the result, operations on studying and developing wells are intensified which enables to study and test wells after drilling with good quality as well as prepare wells for operation by conducting comprehensive studies and tests in different modes, thus improving operation reliability of the well jet device.

DETAILED DESCRIPTION OF THE PREFERRED EMBODIMENT

Figure 1:
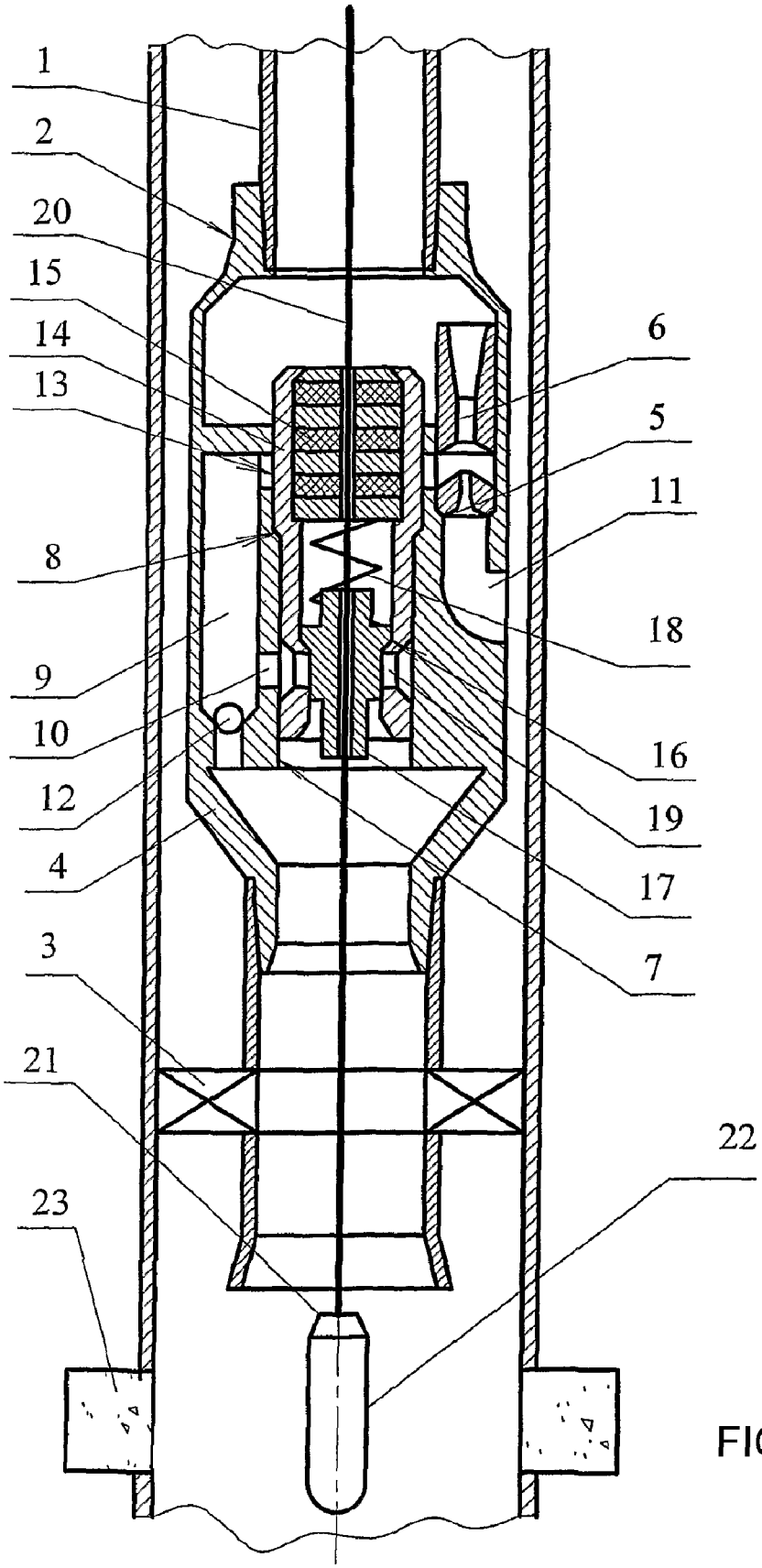
FIG. 1 shows a longitudinal section of the inventive well jet device with a sealing unit and a well logging instrument arranged in a producing formation area.
Figure 2:
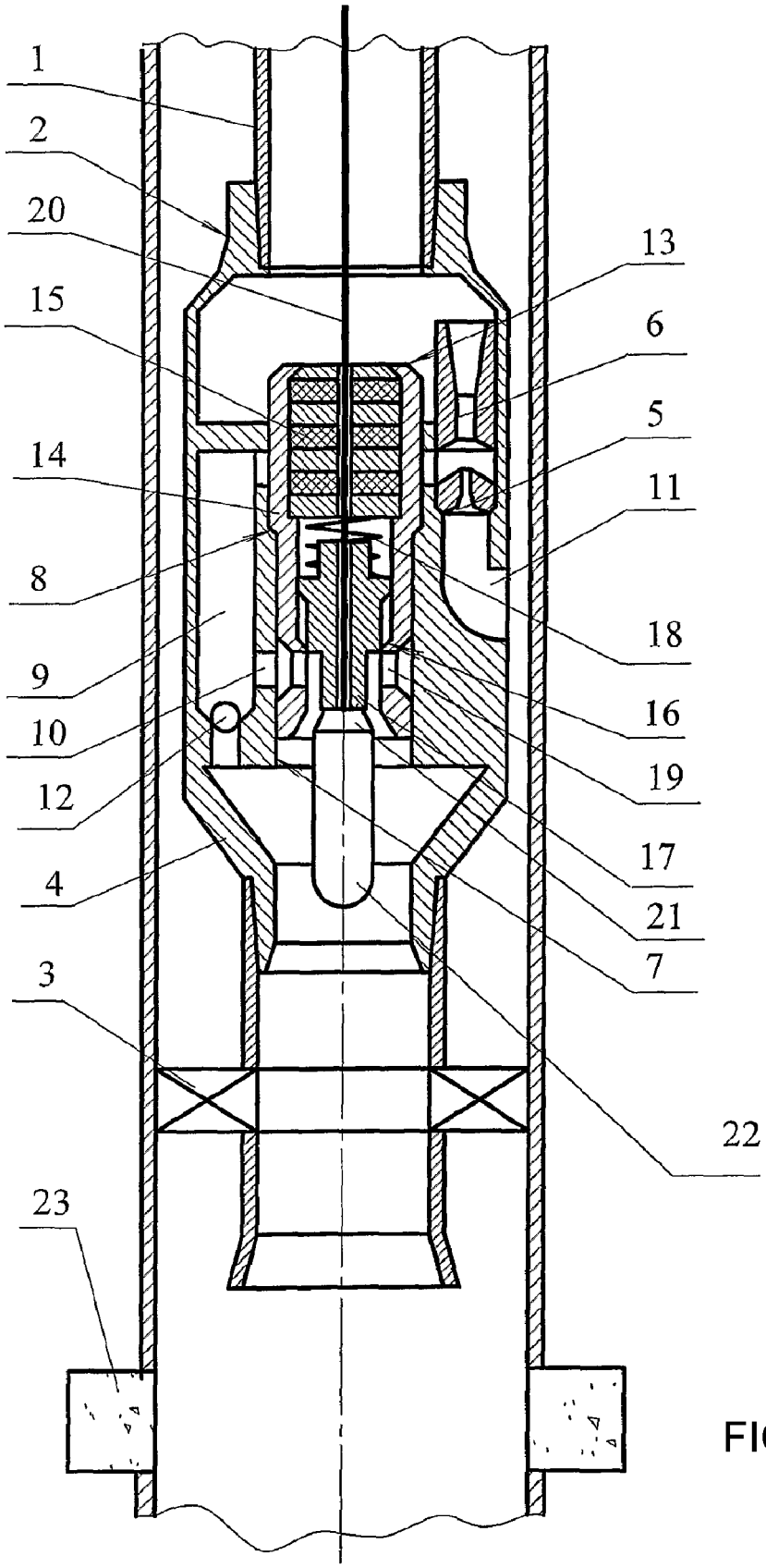
FIG. 2 shows a longitudinal section of the inventive well jet device when preparing it for lifting a well logging instrument and a sealing unit to the surface.

With reference to FIG. 1 and FIG. 2, the inventive well jet device for well-logging operations comprises a jet pump 2 and a packer 3 installed on a pipe string 1, an active nozzle 5 and a mixing chamber 6 with a diffuser being installed in alignment in the body 4 of the jet pump 2 as well as a step-like pass-through channel 7 with a mounting seat 8 between steps, a channel 9 for supplying a medium pumped out of a well, which is in communication below the mounting seat 8 through lateral openings 10 with the step-like pass-through channel 7, and a channel 11 for supplying an active working medium, which is in communication on its output side with the active nozzle 5 and on its input side with annular space of the pipe string 1. The channel 9 for supplying a pumped-out medium is in communication with the pipe string 1 via a return valve 12 below the step-like pass-through channel 7, and the latter is provided with a possibility of installing in it a sealing unit 13 which is made as a hollow step-like cylindrical body 14, in the upper part of which cavity a sealing element 15 is made and below in its cavity a step-like piston 17, which is spring-loaded by a spring 18 against the sealing element 15, is arranged so as to rest on an annular shoulder 16 made in the cavity of the body 14. Openings 19 are made in the wall of the body 14 of the sealing unit 13, which are located opposite to the lateral openings 10 made in the body 4 of the jet pump 2, and the step-like piston 17 in its lower position closes the openings 19 in the wall of the body 14 of the sealing unit 13, and when the step-like piston 17 is in its upper position the channel 9 for supplying a pumped-out medium is connected to the pipe string 1 below the body 4 of the jet pump 2 via the lateral openings 10 and the openings 19 in the wall of the body 14 of the sealing unit 13. Axial channels are made in alignment in the step-like piston 17 and in the sealing element 15 for the purpose of passing a logging cable 20 on which a logging instrument 22 is suspended via a cable head 21 below the body 4 of the jet pump 2.

The proposed method of operating the inventive well jet device is carried out as follows.

A pipe string 1 is assembled by installing a jet pump 2 and a packer 3 on the pipe string 1. The assembly is lowered into a well, and the packer 3 is released; then a sealing unit 13 with a logging instrument 22 attached to a cable 20 via a cable head 21 is lowered into a well. The sealing unit 13 is installed on a mounting seat 8 made in a step-like pass-through channel 7 of the jet pump 2, and the logging instrument 22 is arranged in the area of a producing formation 23. During lowering, background values of rock physical fields, in particular those of thermal fields, are recorded with the logging instrument 22 along the well bore. Then, pressure drawdown on a producing formation 23 is created with the jet pump 2 by supplying an active working medium to the active nozzle 5 along the annular space of the pipe string 1, thus draining the producing formation 23. Then, when the jet pump 2 is operated, current values of rock physical fields and a formation fluid coming to the well are recorded, in the course of recording the logging instrument 22 being moved along the well bore, including the producing formation 23, using the logging cable 20. Then the jet pump 2 is stopped, and the inner cavity of the pipe string 1 above the jet pump 2 together with the annular space above the packer 3 is separated from the inner cavity of the pipe string 1 under the jet pump 2 together with the under-packer space by using a return valve 12 in the channel 9 for supplying a pumped-out medium, thus maintaining a reduced bottom-hole pressure under the packer 3. Then the logging instrument 22 is slightly raised with the use of the logging cable 20, and the step-like piston 17 is pressed by the cable head 21 for moving it up, and, thus, the under-packer space of the well is brought in communication with the inner cavity of the pipe string 1 above the jet pump 2 and the annular space above the packer 3 through the openings 19 in the wall of the body 14 of the sealing unit 13 and the lateral openings 10 in the body 4 of the jet pump 2, and, due to this, pressures above and below the packer are equalized, after which the logging instrument 22 together with the sealing unit 13 is removed from the well.

INDUSTRIAL APPLICABILITY

This invention may be used in the oil-and-gas industry for developing wells after drilling or for carrying out logging operations in any types of wells.

The invention claimed is:

1. A well jet device for well-logging operations, comprising a jet pump, which is installed on a pipe string, and a packer, an active nozzle and a mixing chamber with a diffuser being arranged in alignment in the jet pump body as well as a stepped pass-through channel with a mounting seat between steps, a channel for supplying a pumped-out medium communicating below said mounting seat with said stepped pass-through channel via lateral openings made in the jet pump body, and a channel for supplying an active working medium communicating on the channel's output side with the active nozzle and on the channel's input side with a pipe string annular space being made in the jet pump body, and the channel for supplying a pumped-out medium being connected to the pipe string below the stepped pass-through channel via a return valve, said stepped pass-through channel provides for installation of a sealing unit therein which is made as a hollow stepped cylindrical body with a sealing element in the body's upper part and a stepped piston arranged lower, which is spring-loaded against the sealing element and rests on an annular shoulder made in a sealing unit body cavity; openings are in the sealing unit body wall opposite to said lateral openings in the jet pump body; and the stepped piston in the piston's lower position closes the openings in the sealing unit body wall, and when the stepped piston is in the piston's upper position the channel for supplying the pumped-out medium is connected to the pipe string below the jet pump body via the lateral openings in the jet pump body and the openings in the sealing unit body wall, axial channels being made in alignment in the stepped piston and in the sealing element for the purpose of passing a logging cable on which a logging instrument is suspended via a cable head below the jet pump body.

2. A method of operating a well jet device for well-logging operations, comprising: assembling a pipe string by installing a jet pump and a packer on the pipe string, lowering the assembled pipe string into a well and releasing the packer, lowering a sealing unit on a logging cable with a logging instrument attached to the cable via a cable head, the sealing unit is installed on a mounting seat in a jet pump stepped channel, and the logging instrument is arranged in the area of a producing formation, during lowering background values of rock physical fields, are recorded along the well bore, then pressure drawdown on the producing formation is created by supplying with the jet pump an active working medium to an active nozzle along a pipe string annular space and, thus, the producing formation is drained, then, when the jet pump is operated, current values of rock physical fields and a formation fluid coming to the well are recorded; while recording, the logging instrument being moved along the well bore, including the producing formation, with the use of the logging cable; then the jet pump is stopped, and a pipe string inner cavity above the jet pump together with an annular space above the packer is separated from the pipe string inner cavity under the jet pump together with an under-packer space by using a return valve, maintaining a reduced bottom-hole pressure under the packer, then the logging instrument is slightly raised with the use of the logging cable and the stepped piston is pressed by the cable head for moving the piston up, and, thus, the under-packer space of the well is brought in communication with the pipe string inner cavity through openings in a sealing unit body wall and lateral openings in a jet pump body, and, due to this, pressures above and below the packer are equalized, after which the logging instrument together with the sealing unit is removed from the well.

3. A method of operating a well jet device for well-logging operations according to claim 2, wherein background values of rock physical fields recorded during lowering are those of thermal field.

* * * * *